US007201837B2

(12) United States Patent
Stewart, Jr. et al.

(10) Patent No.: US 7,201,837 B2
(45) Date of Patent: Apr. 10, 2007

(54) ENERGY SOURCE USING HYDROGENATED VEGETABLE OIL DILUTED INTO DIESEL FUEL

(75) Inventors: Wilbur J. Stewart, Jr., Fort Worth, TX (US); Billy R. Cole, Fort Worth, TX (US); Sarah Michalek, Bradley, IL (US); Susan Gleissner, Bradley, IL (US)

(73) Assignee: Bunge North America, Inc., St. Louis, MO (US)

( * ) Notice: Subject to any disclaimer, the term of this patent is extended or adjusted under 35 U.S.C. 154(b) by 587 days.

(21) Appl. No.: 10/101,020

(22) Filed: Mar. 19, 2002
(Under 37 CFR 1.47)

(65) Prior Publication Data

US 2003/0177691 A1 Sep. 25, 2003

(51) Int. Cl.
*C10L 1/04* (2006.01)

(52) U.S. Cl. ..... 208/14; 208/15; 208/56

(58) Field of Classification Search ..... 208/14, 208/15
See application file for complete search history.

(56) References Cited

U.S. PATENT DOCUMENTS 4,575,382 A * 3/1986 Sweeney et al. ..... 44/308

OTHER PUBLICATIONS

James F. Thompson, Jr. "Waste Vegetable Oil as a Fuel Extender", Oct. 1, 1981. pp. 1-B8.*

* cited by examiner

*Primary Examiner*—Tam M. Nguyen
(74) *Attorney, Agent, or Firm*—Cook, Alex, McFarron, Manzo, Cummings & Mehler, Ltd.

(57) ABSTRACT

An alternative fuel source, preferably for use in a boiler, is provided. The fuel source is comprised of a partially hydrogenated vegetable oil and diesel fuel. Preferably, the partially hydrogenated vegetable oil has a Iodine Value (IV) ranging from approximately 50 to approximately 120.

7 Claims, No Drawings

ENERGY SOURCE USING HYDROGENATED VEGETABLE OIL DILUTED INTO DIESEL FUEL

BACKGROUND OF THE INVENTION

1. Field of the Invention

The present invention is related to combustible fuels, such as those used in boiler operations for the purpose of producing steam as an energy source. More particularly, the present invention is directed to a mixture of partially hydrogenated vegetable oil and diesel fuel to be used as a combustible medium. The present invention is also directed to a method of operating a diesel boiler with such a mixture and a process for producing such a mixture.

2. Description of the Related Art

Companies today are searching for alternative renewable, cleaner burning energy sources, particularly for industrial use, for environmental and regulatory reasons. Further, limited resources of natural gas, diesel fuel and coal has created a further need for such alternative fuel sources.

In particular, a typical combustion medium in boilers is pure diesel fuel. When pure diesel fuel is burned in a boiler, the smoke stack associated with the boiler will output an emission with a significant sulfur content. Since a high sulfur content in the outputted emission is considered hazardous for the environment, these emissions are the subject of considerable government regulations. As a result of such environmental concerns and regulations, there is a need for fuels with reduced sulfur content. This need is expected to be even greater in the future as new and stricter regulations on exhaust emissions will require even lower sulfur levels.

Additionally, it is desirable to lower the cost of fuel for a boiler and to reduce reliance on pure diesel fuel. As a result, there is a need for a fuel which is something other than pure diesel fuel and which can be less costly than a fossil fuel. The use of partially hydrogenated vegetable oil and diesel fuel may in some circumstances be less costly than diesel fuel alone.

There have been a variety of attempts to produce an acceptable alternative fuel composition. For example, in U.S. Pat. No. 5,578,090 (Bradin), biodiesels of esters of free fatty acids and ethers of glycerol with oil were tried. These esters, for example, are formed in the presence of acid as a catalyst. However, the method for producing such a biodiesel involves refining or processing of the fuel additive composition before it can be used as a combustible medium in a fuel boiler. In particular, these biodiesels require additional processing to chemically cleave free fatty acids from vegetable oil molecules. In this prior approach, the esters of free fatty acids are created by a reaction with either methanol or glycerol. These free fatty acids, however, are extremely corrosive and difficult to handle once isolated. Further, the additional steps necessary for this process are costly and inefficient.

Prior products have included certain other additives added to hydrocarbon oils. For example, U.S. Pat. No. 2,243,198 (Dietrich) is directed to the addition of a hydrogenated castor oil derivative to a non-viscous normally liquid hydrocarbon oil. The castor oil derivative, however, is added to increase lubricity and decrease the pour point of the liquid hydrocarbon oil. Further, the castor oil is used in such a small amount (0.1–2%) that the hydrocarbon oil in Dietrich '198 cannot really be considered an alternative fuel source in as much as the castor oil is unlikely to significantly impact the cost of the hydrocarbon oil or the emission output if they were to be used as a boiler fuel, for example. Dietrich '198 also uses a hydrogenated castor oil derivative which requires additional processing and expense to produce.

Another fuel oil composition is disclosed in U.S. Pat. No. 6,265,629 (Fava et al.) In this patent, a heavy gas component, such as a transesterfied vegetable oil, is used to enhance the lubricity of fuel oil. The transesterfication of the oil represents an addition expense which is a consequence of this process.

U.S. Pat. No. 4,992,605 (Craig et al.) discloses a process for producing liquid paraffinic hydrocarbons in the $C_{15}$–$C_{18}$ range. The hydroprocessing in the process disclosed in Craig et al. '605 is a severe process, which not only hydrogenates the oil, but also breaks the chemical structure to form paraffinic hydrocarbon chains. The resulting structure is not a vegetable oil. Further, it is an additive, rather than a fuel source to be used as an energy source.

It is accordingly a general object of the present invention to overcome each of the noted drawbacks in the prior art. An object is to provide improved products and methods which produce a fuel mixture of partially hydrogenated vegetable oil and #2 diesel fuel. This fuel mixture may be more cost effective, is a renewable energy resource and emits a lower sulfur content when burned, when compared with #2 diesel fuel alone, for example.

SUMMARY OF THE INVENTION

The present invention is directed toward a fuel composition comprised of a partially hydrogenated vegetable oil as an additive fuel to #2 diesel fuel. In a preferred embodiment, the partially hydrogenated vegetable oil has a Iodine Value (IV) ranging from approximately 50 to approximately 120. In a further preferred embodiment, the fuel composition comprises between about 70 and 80 volume percent of #2 diesel fuel and between about 15 and 30 volume percent of the partially hydrogenated vegetable oil. One resultant advantage of this fuel composition is a cleaner burning, renewable fuel source. Another advantage is a potential cost saving which results by reducing the amount of diesel fuel used in the process by replacing diesel fuel with vegetable oil.

The method for producing such a mixture involves no reprocessing of the partially hydrogenated vegetable oil, but only blending with the diesel fuel. Once blended, the mixture can be used as boiler fuel to operate a boiler.

DETAILED DESCRIPTION OF THE PRESENTLY PREFERRED EMBODIMENTS

The present invention is directed to using partially hydrogenated vegetable oil to provide an advantageously diluted diesel fuel to form a mixture for use as boiler fuel. The resulting fuel mixture may be more cost effective and is more environmentally friendly than pure diesel oil and also saves natural resources. Once properly and effectively evenly dispensed into the diesel fuel, the vegetable oil component does not separate from the diesel fuel component.

The vegetable oil can be, for example, soybean oil, corn oil, cottonseed oil or canola oil or any other partially hydrogenated vegetable oil. Preferably, the partially hydrogenated vegetable oil has an Iodine Value (IV) of approximately 50–120. Partially hydrogenated vegetable oils in the higher end of this IV range are readily pourable and mix easily with diesel fuel. Partially hydrogenated vegetable oils at the lower end of this IV range (less than about 80 IV) often will be too viscous or thick to be combined directly with diesel fuel. However, these lower IV partially hydrogenated vegetable oils can be used in the present invention if heated, to about 100° F.–135° F. for example, prior to mixing with diesel fuel, in order to make the oil freely flowable. It has been determined, in conjunction with the present invention, that with such heated lower IV oils, once combined with diesel fuel, the oil will not re-thicken. This feature minimizes the possibility that the resulting fuel will foul injectors or the like.

It is necessary to mix the vegetable oil and diesel fuel with agitation or similar means, prior to being fed to the boiler, so as to insure a consistent blend. Once the mixture is formed, the method of introduction and burning of the mixture is the conventional method used in the common diesel fuel boiler operation.

The partially hydrogenated vegetable oil can be produced using conventional methods of vegetable oil refining and partial hydrogenation. For example, crude oil (extracted from the bean or other vegetable source or plant) goes through a series of reaction, separation and bleaching stages to remove all inedible or undesirable components such as free fatty acids, phosphatides, color and other miscellaneous impurities. This now refined and bleached vegetable oil is sometimes partially or fully hydrogenated. It is this step that changes the fluidity of the product from a pure liquid to a semi-solid or solid, depending upon the resulting IV level.

The present invention is especially useful in a facility, which produces vegetable oil, especially partially hydrogenated vegetable oil, by saving cost and time. More specifically, the above production steps can be used unaltered from their normal state of operation to produce vegetable oil. The partially hydrogenated vegetable oil used in the present invention can be excess or substandard (rework) vegetable oil. Since, in general, rework requires reprocessing, blending or the extra cost of disposal, using such oil in the present invention serves as a useful and cost-effective outlet for assisting in eliminating rework oil and providing the necessary fuel for the boiler.

Alternatively, the partially hydrogenated vegetable oil can be purchased, such as, for example, rework or other oil from another facility, and then mixed into the diesel fuel in accordance with the present invention. Appropriate action thereafter, depending upon the oil's IV level, will be taken as discussed herein.

The following examples are being provided for illustration purposes only and are not intended to limit the scope of the present invention.

EXAMPLE 1

Mixing was done in a 73 cubic foot mixing tank equipped with agitation. All measurements were made manually and performed on a volume basis. The volume of diesel fuel in the mixing tank was between about 50 cubic feet and about 54.5 cubic feet. An additional 20–50% of the diesel fuel volume was added with agitation as partially hydrogenated vegetable oil. The partially hydrogenated vegetable oil used in this Example had a general composition of 65 IV. The vegetable oil was semi-solid and was heated to about 100° F. and immediately fed to the mixing tank. Agitation continued for 5–7 minutes.

The mixture fueled the fire-side of a Two-drum type Zurn Boiler, model SAO-MJ with 3315 square feet of heating surface and a Maximum Allowable Working Pressure (MAWP) of 250 pounds. The feed-water stream came from a city source that had been degassified, deaerated and softened. Pressure in the deaerator was maintained at 8 psi.

A control sample of 100% #2 diesel in the feed stream was run for 80–100 minutes at 150–160 psig steam pressure, producing 9000–11000 pounds per hour of steam. With the addition of the partially hydrogenated vegetable oil at 20% of the control volume of diesel fuel, a 15% increase in steam production was measured.

The increase in energy production in the above example can be attributed to the addition of the partially hydrogenated vegetable oil to the diesel fuel because the level of diesel fuel remained constant so as to be comparable with the amount in the control. Hence, in order for there to have been an increase in steam production, the increase had to be the result of burning the partially hydrogenated vegetable oil, indicating that the vegetable oil was an acceptable source of energy comparable to the #2 diesel fuel. The reduction in the % of steam produced compared to the % composition of partially hydrogenated vegetable oil in the fuel was due to the lower heating value of the partially hydrogenated vegetable oil compared to the #2 diesel fuel.

It was also confirmed in Example 1 that by diluting diesel fuel with partially hydrogenated vegetable oil, sulfur emissions measured as sulfur dioxide in the flue gas were reduced from 7 ppm to 3 ppm due to the absence of sulfur compounds in the vegetable oil. In all trials, no gases were noticed leaving the stack, further indicating a clean combustion process.

EXAMPLE 2

Blends were run using various concentrations from 0–50% by volume of partially hydrogenated vegetable oil, with the remainder being #2 diesel fuel. The diesel fuel and partially hydrogenated vegetable oil were mixed in a tank with agitation and fed to the boiler from the tank. The oxygen control was set on manual and due to the lower heating value of the partially hydrogenated vegetable oil, the boiler efficiency and steam production decreased on a relative basis as the % of the partially hydrogenated vegetable oil feed was increased and as the oxygen levels in the flue gas increased. Due to this, the steam production shows a relative decrease with the addition of the vegetable oil to the mixture. However, in normal implementation, the oxygen levels would be adjusted and maintained. This aids in maximizing the efficiency of the boiler. With values of approximately 50% vegetable oil, some plugging was found in the boiler. However at lower volumes, such as for example 15–30% by volume vegetable oil, no signs of plugging or other complications were found after running the boiler for up to 3.5 hours.

The air inlet control valve for the boiler was left in manual control during all of the trials, resulting in a rise in the flue gas oxygen level with increasing partially hydrogenated vegetable oil in the fuel and as the combustion occurred. This lowered the overall efficiency of the boiler and therefore the steam production due to heat and energy losses expended to heat ambient air. In a conventional setting, it would be ideal to maintain an optimum level of oxygen in the flue gas so as to maximize the efficiency of the system.

It will be understood that the embodiments of the present invention which have been described are illustrative of some of the applications of the principles of the present invention. Numerous modifications may be made by those skilled in the art without departing from the true spirit and scope of the invention.

The invention claimed is:

1. A fuel composition comprised of a mixture of:

between about 70 and about 85 volume percent of a #2 diesel fuel; and between about 15 and 30 volume percent of a partially hydrogenated vegetable oil, wherein said partially hydrogenated vegetable oil has an Iodine Value of between approximately 50 and approximately 120 and wherein the volume percents are based upon the total volume of the fuel composition.

2. The fuel composition of claim 1, wherein said partially hydrogenated vegetable oil is selected from the group consisting of soybean oil, corn oil, cottonseed oil and canola oil.

3. The fuel composition of claim 1 wherein said fuel composition is a combustible fuel source for use in a boiler.

4. A fuel composition comprised of a flowable mixture of:

between about 70 and about 85 volume percent of a #2 diesel fuel; and between about 15 and 30 volume percent of a partially hydrogenated vegetable oil being a semi-solid having an Iodine Value between about 50 and about 80, wherein said vegetable oil had been heated to make it liquid prior to forming the mixture;

whereby said mixture remains flowable so as to be a non-fouling fuel composition.

5. The fuel composition of claim 4, wherein said partially hydrogenated vegetable oil is selected from the group consisting of soybean oil, corn oil, cottonseed oil and canola oil.

6. The fuel composition of claim 4 wherein said fuel composition is a combustible fuel source for use in a boiler.

7. A fuel composition mixture for use as a combustible fuel source in a boiler consisting essentially of between about 70 and about 85 volume percent of a #2 diesel fuel and between about 15 and 30 volume percent of a partially hydrogenated vegetable oil, based upon the total value of the fuel composition mixture, wherein said partially hydrogenated vegetable oil has an Iodine Value of between approximately 50 and approximately 120.

* * * * *